US006148731A

United States Patent [19]

Winter

[11] Patent Number: 6,148,731

[45] **Date of Patent: *Nov. 21, 2000**

[54] EXPANSION PROJECTILE

[76] Inventor: Udo Winter, Losensteinerstrasse 23, A-4020 Linz, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/171,496

[22] PCT Filed: Apr. 24, 1997

[86] PCT No.: PCT/AT97/00078

§ 371 Date: Oct. 20, 1998

§ 102(e) Date: Oct. 20, 1998

[87] PCT Pub. No.: WO97/40334

PCT Pub. Date: Oct. 30, 1997

[30] Foreign Application Priority Data

Apr. 24, 1996 [AT] Austria ..... 739/96

[51] Int. Cl.[7] ..... F42B 12/34

[52] U.S. Cl. ..... 102/509; 102/501

[58] Field of Search ..... 102/501, 506–510, 102/514–519

[56] References Cited

U.S. PATENT DOCUMENTS

| | | | |
|---|---|---|---|
| 3,881,421 | 5/1975 | Burcynski . | |
| 4,044,685 | 8/1977 | Avcin . | |
| 4,136,616 | 1/1979 | Schirneker . | |
| 5,160,805 | 11/1992 | Winter | 102/518 |
| 5,185,495 | 2/1993 | Petrovich et al. . | |
| 5,187,325 | 2/1993 | Garvison | 102/509 |

FOREIGN PATENT DOCUMENTS

| | | | |
|---|---|---|---|
| 25 41 632 | 3/1977 | Germany . | |
| 36 38 721 | 5/1987 | Germany . | |
| WO 94/08201 | 4/1994 | WIPO | 102/518 |

*Primary Examiner*—Harold J. Tudor
*Attorney, Agent, or Firm*—Collard & Roe, P.C.

[57] ABSTRACT

An expansion projectile (1) with a projectile body (2) forms a central arbor (3) at its end face and a collar (4) coaxially surrounding the arbor (3), where the collar (4) has an outer shape (6) tapering towards the free collar edge (5), and between collar (4) and arbor (3) there is provided a cavity (7) open towards the front. In order to achieve a monobloc projectile free from lead with a high efficiency and a wide range of applications in an economic way, the arbor (3) consists of shaft (31) and tip (32) the collar (4) touches the arbor (3) at least in the transition area (33) between shaft (31) and tip (32), and the arbor (3) protrudes at least up to the axial height of the collar edge (5).

9 Claims, 3 Drawing Sheets

Figure 1:
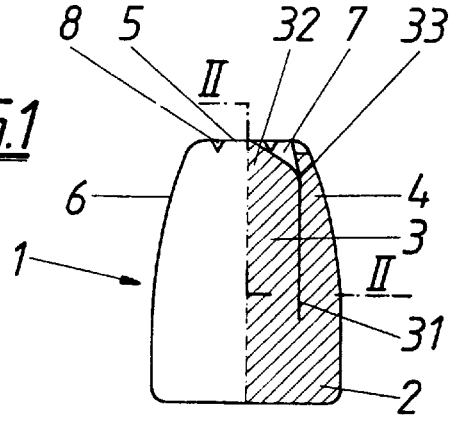

212
214
1c
213
1

114
112
113
1b
1c 12
14
13
1a
1b

EXPANSION PROJECTILE

This invention relates to an expansion projectile with an integral projectile body which at its end face forms a central arbor and a collar coaxially surrounding the arbor, where the collar has an outer shape tapering towards the free edge of the collar, and between collar and arbor a cavity is provided which is open towards the front.

Expansion projectiles, which upon impact on a soft target medium mushroom open through cavities open towards the front in the vicinity of the nose of the projectile and due to the related expansion lead to a great shock effect, are available in all kinds of variants, and in accordance with U.S. Pat. No. 3,881,421 it is also already known to form inside this cavity a forwardly directed, bluntly rounded arbor, so that during the penetration into the target medium after the first expansion of the collar surrounding the arbor, the medium is opened by the protruding arbor and expansion is facilitated. These projectiles mostly consist of a core of soft, but heavy metal, in particular lead, in order to achieve a sufficient projectile weight despite the cavity, and of a projectile jacket of hard metal, preferably copper, copper alloys or soft iron, in order to improve the firing conditions through the barrel of a weapon. Expansion projectiles in a monobloc design made of copper, copper alloys or soft iron or the like have not gained acceptance so far, as they must mostly be machined and have a reduced weight as compared to a lead-core projectile. However, the expansion projectiles made of lead or with a lead core produce splinters when mushrooming open in the soft target material, or at least during the penetration into the target medium a considerable abrasion of lead occurs at the surface of the deformed projectile, which involves a very undesired dangerous contamination, so that it is desired to largely avoid lead and lead alloys in the production of projectiles. Moreover, due to their expansion effect the known expansion projectiles exhibit only a small penetration effect when striking on a hard target material, and in practice can therefore only be utilized for a special ammunition. Last but not least, the cavities at the nose of the projectile frequently lead to difficulties when feeding a bullet from the magazine into the barrel of a self-loading weapon, which in part already requires the closure of the cavity by means of a special cap, which cap, however, substantially complicates the production of projectiles, as is shown in U.S. Pat. No. 4,136,616, and does still not involve any protection against jams.

It is therefore the object underlying the invention to eliminate these deficiencies and create an expansion projectile as described above, which can be produced economically as a monobloc projectile without using lead or lead alloys, which is characterized by its wide range of applications and penetrates into soft target medium without producing splinters, and which, last but not least, is fully suitable for automatic weapons.

This object is solved by the invention in that the arbor consists of shaft and tip, that the collar touches the arbor at least in the transition area between shaft and tip, and that the arbor protrudes at least up to the axial height of the edge of the collar. There is obtained an integral projectile body, which can be produced with comparatively little effort in a multi-stage pressing operation from a cylindrical starting material, so that this monobloc projectile can also be produced as desired from copper, a copper alloy such as tombac, or soft iron. Since collar and arbor only leave a relatively small cavity, a rather high weight is achieved as compared to other expansion projectiles, so that lead cores and the like can be omitted without a loss in firing efficiency. For this purpose, collar and arbor are mostly pressed against each other along the entire height of the arbor shaft, but in exceptional cases there may also be left a narrow ring-shaped cavity between collar and arbor in the vicinity of the shaft, which involves the advantage that the press-in resistance of the projectile into the grooves of a fire arm barrel is smaller than in the firmly pressed embodiments, and thus the maximum gas pressure is also slightly smaller. The arbor protruding with its tip towards the edge of the collar or beyond forms such a small cavity together with the surrounding edge of the collar that it is sufficient to unroll and mushroom open the collar upon impact on a soft target medium, which expansion is correspondingly improved by the leading arbor, but that it no longer causes such mushrooming open when the projectile strikes on a hard target medium, and upon impact the edge of the collar is urged against the tip of the arbor and the projectile reacts like a full-jacket projectile. On the one hand, splinter-free expansions with a high shock effect are therefore achieved in a soft target medium, and on the other hand great penetration effects are achieved in a hard target medium. Care should, however, be taken that the free height of the collar from the transition area between shaft and tip of the arbor on the inside up to the edge of the collar corresponds to not more than the length of a surface line of the arbor tip extending in an axial plane from this transition area to the axis, so that when pressing the edge of the collar against the tip of the arbor at the end face, the edge of the collar cannot be compressed beyond the tip of the arbor, which would involve the risk of unrolling. The arbor correspondingly protruding upwards also leads to a high dimensional stability of the projectile, which involves favorable ballistic properties and above all avoids difficulties when feeding the projectile to the barrel of self-loading weapons.

When the shaft substantially has an axially symmetrical shape with straight axially parallel generatrixes or with generatrixes inclined forward towards the axis, and when the adjoining tip has an obtuse-angled axial section, there are obtained favorable conditions for the production of the projectile body by means of a pressing method, and it is possible to perfectly place the collar against shaft and tip of the arbor, which is important above all in the tip area of the arbor upon impact on a hard target medium. The shaft of the arbor will mostly have the shape of a cylinder or a truncated cone, but it is also possible to design the shaft in the shape of a prism or a truncated pyramid, which when placing the collar against tip and shaft produces notch-related preset breaking points along the edges, which facilitate a mushrooming open of the collar due to its division into strips.

When the collar is pressed in radially in the edge portion, the projectile diameter will decrease more towards the tip than by the mere outer shape of the collar, which improves the suitability of the projectile for self-loading weapons.

The collar may also be pressed against the arbor tip in the edge portion, so that the size of the cavity open towards the front is minimized and the suitability of the projectile as a full-jacket projectile can be increased.

In order to improve the mushrooming open of the projectile body upon impact on a soft target medium independent of the design of the arbor, the collar may have preset breaking points in the edge portion, which due to the stripwise division of the collar facilitate unrolling the collar against the firing direction. It is possible to provide the preset breaking points by means of notches or the like at the inside or outside of the jacket or only at the collar edge.

To achieve a special penetration effect even in the case of very hard objects such as steel, bullet-proof glass or the like, a sheath of hard material may be put over the arbor, which can also influence the projectile weight.

In accordance with a further aspect of the invention, the projectile body has a recess on its bottom, which possibly extends into the arbor. This recess may remain hollow in order to reduce the projectile weight, but to increase the weight it may also be filled with specifically heavy material such as tungsten, bismuth etc., and it also offers the possibility to fill in a chemical mass producing a luminous trace upon firing.

When the arbor has a cavity open towards the tip, the expansion effect may be increased for special cases, as upon impact on soft target medium both the collar and the arbor will unroll.

Figure 2:
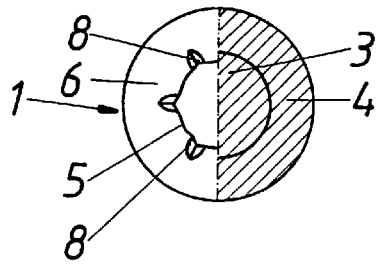
Figure 3:
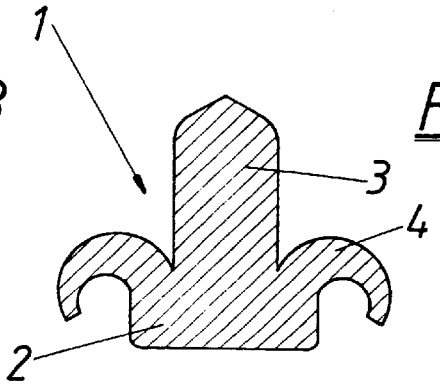
Figure 4:
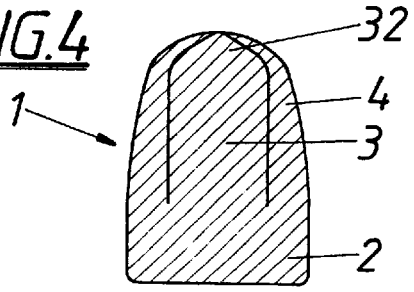
Figure 5:
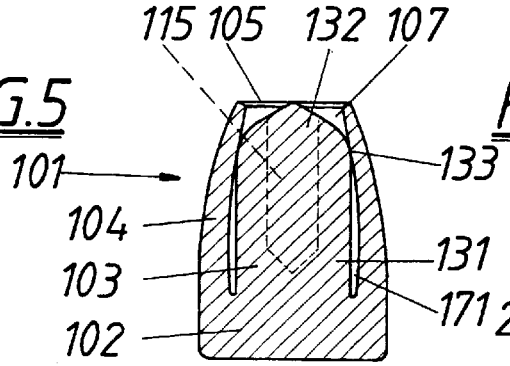
Figure 6:
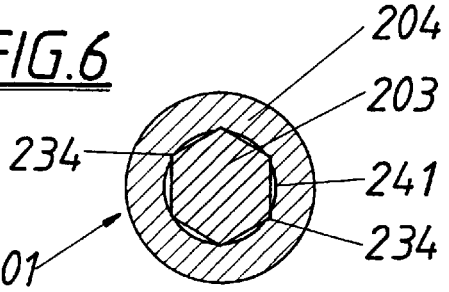
Figures 13, 14, 15:
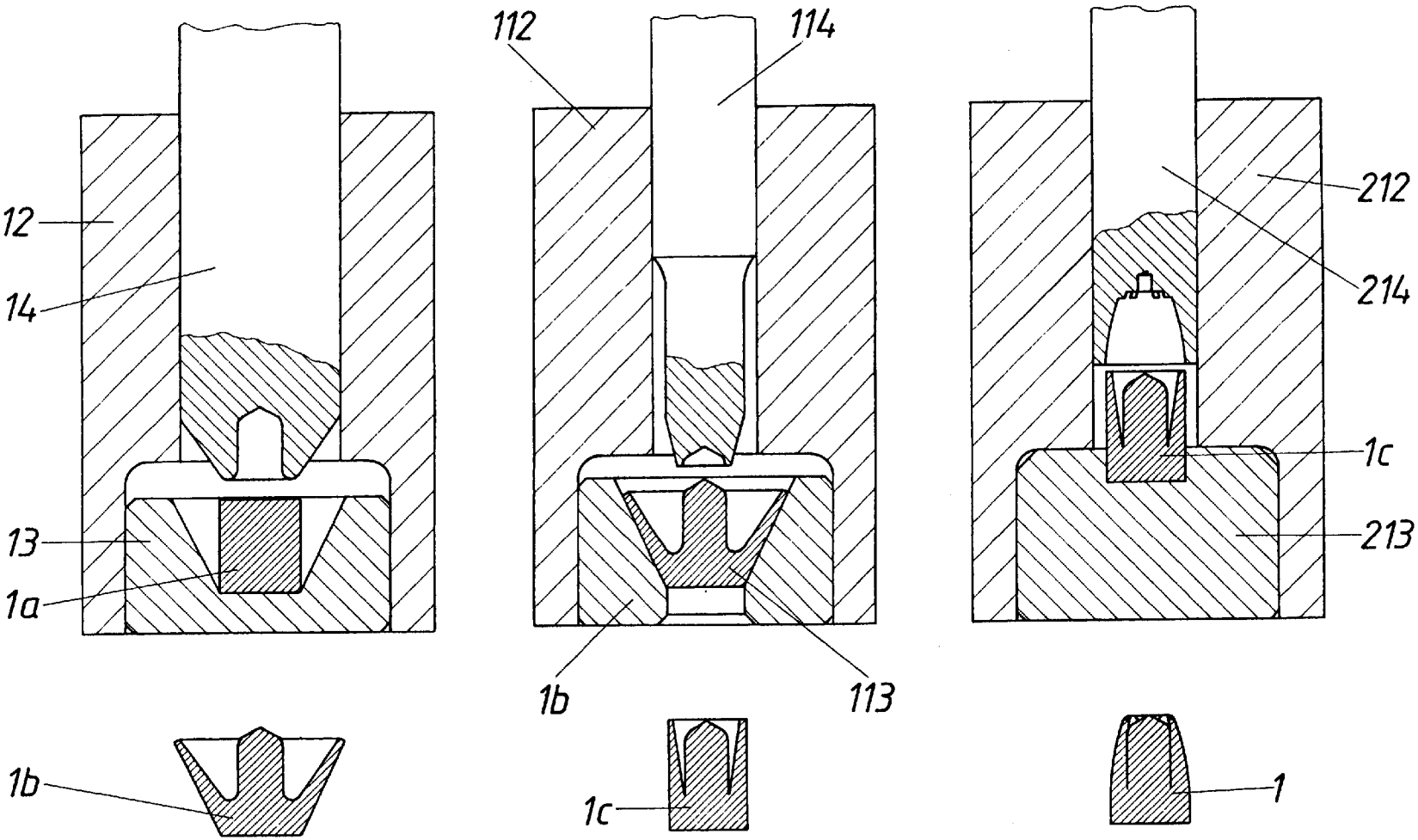

In the drawing, the subject-matter of the invention is illustrated schematically, wherein:

FIGS. 1 and 2 represent an inventive expansion projectile in a partly sectional side view and in a cross-section along line II—II of FIG. 1, FIGS. 3 and 4 represent this expansion projectile upon striking on a soft or hard target medium in an axial section, FIG. 5 represents a modified embodiment of an inventive expansion projectile in an axial section, FIG. 6 represents a further embodiment of an expansion projectile in a cross-section, FIGS. 7 to 12 represent various embodiments of an inventive expansion projectile, each in an axial section, and FIGS. 13 to 15 illustrate the production of an inventive expansion projectile with reference to three production steps, each in a functional diagram.

In accordance with FIGS. 1 and 2 an expansion projectile 1 consists of a projectile body 2, which at its end face verges into a central arbor 3 and a collar 4 coaxially surrounding the arbor, where the collar 4 has an outer shape 6 tapering towards the collar edge 5, and between collar 4 and arbor 3 there is provided a cavity 7 open towards the front. The projectile body 2 is made as monobloc, preferably of copper or a copper alloy or of soft iron, and to increase the weight related to the total volume, arbor 3 and collar 4 are largely closely pressed against each other. The arbor 3 forms a shaft 31 and a tip 32, it protrudes up to the axial height of the collar edge 5, and the collar 4 touches the shaft 3 at least in the transition area 33 between shaft 31 and tip 32.

There is obtained a monobloc projectile free from lead, which due to the only small cavity 7 in the tip portion nevertheless has a comparatively high projectile weight. Due to the particular design of arbor and jacket this expansion projectile reacts like a usual expansion projectile when penetrating into a soft target medium with the collar 4 mushrooming open (FIG. 3), which leads to a high shock effect, but upon impact on a hard target medium it behaves like a full-jacket projectile with a high penetration effect, as due to the impact on hard surfaces the edge portion of the collar 4 is pressed against the arbor tip 32 (FIG. 4). By means of specific design differences between arbor and collar, the expansion effects or full-jacket effects can be influenced as desired, where preset breaking points 8 in the edge portion of the collar 4 lead to the collar 4 unrolling in segments against the firing direction and may thus additionally improve the expansion.

Due to the upwardly protruding arbor 3 and the contact between arbor 3 and collar 4 in the transition area 33 from the shaft 31 to the tip 32, the collar 4 of the projectile 1 is supported on the inside with dimensional stability, which provides favorable ballistic properties, and the projectile is in addition suitable for self-loading weapons.

The expansion projectile in accordance with the invention can be adapted in various ways to special objects and effects, without having to be changed in its basic structure:

In an expansion projectile 101 in accordance with FIG. 5, the basic body 102 is equipped with an arbor 103 and a collar 104, which collar 104 touches the arbor 103 merely in the transition area 133 between shaft 131 and tip 132, so that between the collar 104 and the arbor shaft 131 an annular gap 171 is left, which reduces the press-in resistance of the projectile 101 into the grooves of the barrel of a weapon. This annular gap 171 does not contribute to the expansion effect as a result of the cavity 107 between arbor tip 132 and collar edge 105, which is open towards the front. As is indicated in broken lines, the arbor 103 may also have a cavity 115 open towards the tip 132, so that collar 104 and arbor 103 mushroom open upon impact on a soft target medium, and the expansion effect is increased. In addition, this cavity 115 contributes to an increase of the radial elasticity of the basic body 102.

In accordance with FIG. 6, the arbor 203 of an expansion projectile 201 may have a polygonal, for instance hexagonal cross-section, so that the edges 234 pressed into the inner wall 241 of the collar 204 produce preset breaking points, which act like the notches 8 in the vicinity of the collar edge 5 shown in FIGS. 1 and 2 and facilitate the unrolling of the collar 204 upon impact on a soft target medium.

Figure 7:
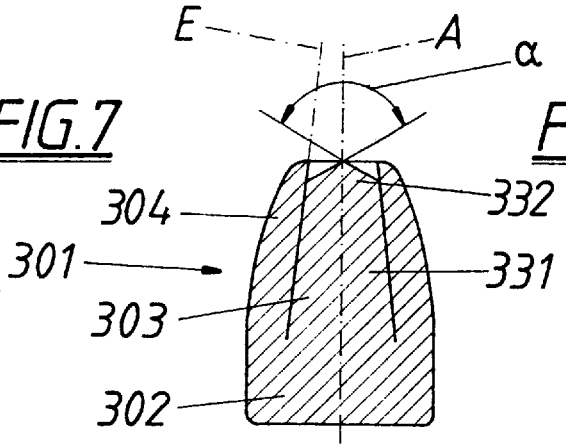

In accordance with FIG. 7, the expansion projectile 301 with its basic body 302 forms an arbor 303, which has an axially symmetrical shape with a straight generatrix E inclined forward towards the axis A, where a circular cross-section provides a truncated cone, or a polygonal cross-section provides a truncated pyramid. The associated collar 304 conforms to the arbor shaft 331. The tip 332 adjoining the shaft 331 has a blunt conical axial section, i.e. in an axial section the opening angle a is at least 90°.

Figure 8:
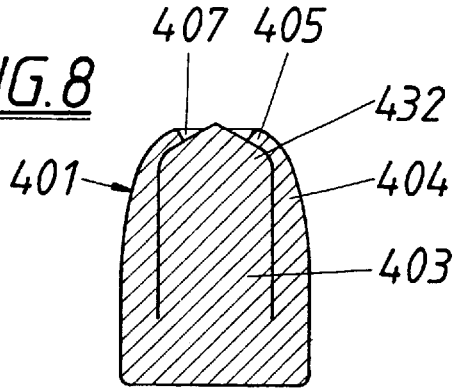

In accordance with FIG. 8, there is provided an expansion projectile 401, where the collar 404 is pressed against the arbor 403 along the entire inner wall, so that the area of the collar edge 405 also rests on the surface of the arbor tip 432. There is only left a very small cavity 407 open towards the front, so that the full-jacket effect of the projectile is increased.

Figure 9:
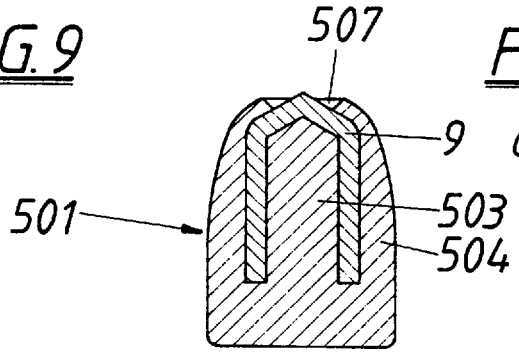

In accordance with FIG. 9, the expansion projectile 501 is designed to also penetrate through particularly hard objects, for which purpose a sheath 9 of hard material, for instance a steel cap, has been put onto the arbor 503. Here as well, largely pressing the collar 504 against the sheath 9 of hard material, which has a shape conformal to the arbor 503, provides for rather small cavity 507 open towards the front.

Figure 10:
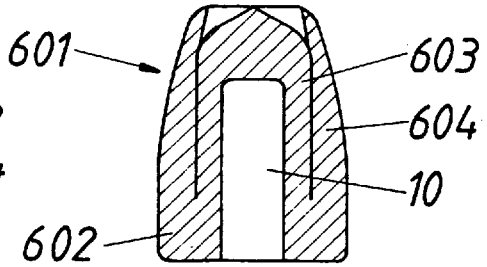

In accordance with FIG. 10 an expansion projectile 601 is illustrated, whose projectile body 602 verges at its end face into an arbor 603 and a collar 604 coaxially abutting against the arbor. The projectile body 602 is, however, provided with a recess 10 open at the bottom, which may for instance accommodate a chemical mass producing a luminous trace upon firing, but may also remain hollow to influence the projectile weight, or may be filled with a specifically heavy material.

Figure 11:
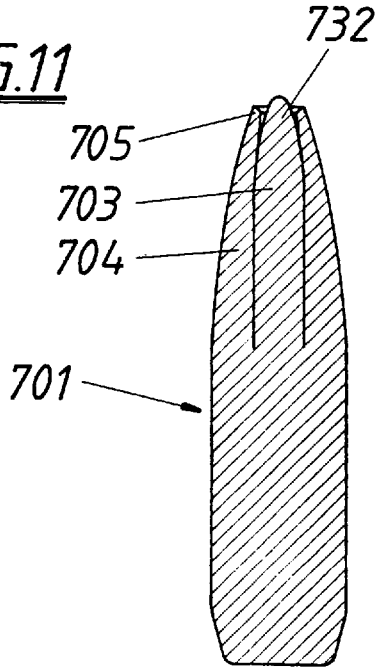

In accordance with FIG. 11 there is shown an expansion projectile 701 to be used for hunting, where the arbor 703 protrudes over the edge 705 of the collar 704 with a narrow tip 732.

Figure 12:
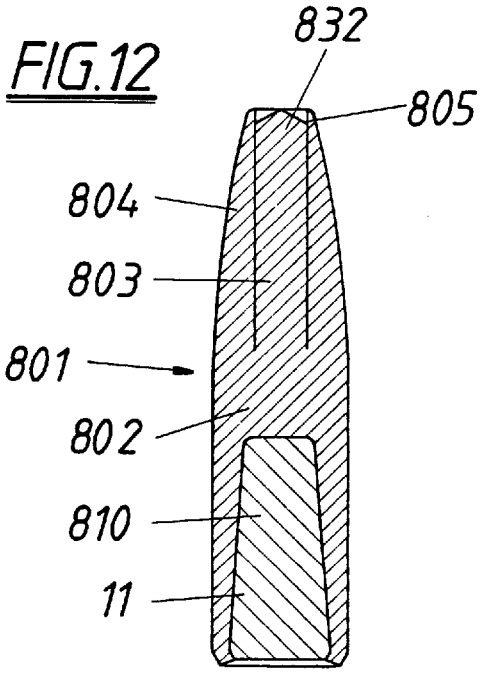

In accordance with FIG. 12 there is illustrated a similar expansion projectile 801 to be used for hunting, whose arbor 803 with its blunt arbor tip 832 again protrudes into the axial height of the collar edge 805 of the collar 804. The projectile body 802 is provided with a recess 810 at its bottom and is fitted with an additional weight 11 of a specifically heavy material such as tungsten or bismuth, but also lead.

As is illustrated in FIGS. 13, 14 and 15, an expansion projectile 1 in accordance with the invention can be produced in few steps by means of a pressing method largely without machining, where a cylindrical blank 1*a* is employed. In accordance with FIG. 13, this blank 1*a* is placed in a pressing tool 12 comprising a female mold 13 and a male mold 14, and in a first pressing step is pressed to a frustoconical blank 1*b* with arbor and collar. In the following pressing step shown in FIG. 14, this blank 1*b* is put into a pressing tool 112 comprising a female mold 113 adapted to the blank and a suitable male mold 114, so that with this tool a raw projectile 1*c* of a cylindrical basic shape with collar and arbor is made, whereupon in the next pressing step shown in FIG. 15 a suitable tool 212, which has a corresponding female mold 213 and a suitable male mold 214, is used for pressing the finished expansion projectile 1 from the raw projectile 1*c*, where the notches at the edge provided for the preset breaking points in the collar can be impressed already at this method step. Depending on the special shape of the projectile or the associated arbor or collar, this pressing method can of course be completed and expanded to the required extent by additional method steps.

What is claimed is:

1. An expansion projectile comprising a monobloc projectile body having an end face, the end face of the monobloc projectile body formed by (a) a central arbor consisting of
  (1) a shaft having an axis and
  (2) a tip, and (b) a collar having a free edge radially pressed inwardly toward the axis,
  (1) the collar coaxially surrounding the central arbor and having an outer shape tapering towards the free edge,
  (2) a cavity being defined between the central arbor shaft and the collar, the cavity being open towards the end face,
  (3) the collar touching the central arbor shaft at least in a transition area between the central arbor shaft and tip, and
  (4) the central arbor shaft protruding at least to the axial height of the free collar edge.

2. The expansion projectile of claim 1, wherein the central arbor shaft is substantially axially symmetrical, and the central arbor tip has an obtuse-angled axial section.

3. The expansion projectile of claim 2, wherein the central arbor shaft has straight generatices extending parallel to the axis.

4. The expansion projectile of claim 2, wherein the central arbor shaft has generatrices inclined towards the axis in the direction of the end face.

5. The expansion projectile of claim 1, wherein the free collar edge has been pressed inwardly against the central arbor tip.

6. The expansion projectile of claim 1, wherein the free collar edge has preset breaking points.

7. The expansion projectile of claim 1, wherein the monoblock projectile body has a recess at an end thereof opposite to the end face.

8. The expansion projectile of claim 7, wherein the recess extends into the central arbor shaft.

9. The expansion projectile of claim 1, wherein the central arbor shaft has a cavity open towards the tip.

* * * * *